United States Patent [19]

Freedman

[11] Patent Number: 4,843,823

[45] Date of Patent: Jul. 4, 1989

[54] USE OF EJECTORS FOR HIGH TEMPERATURE POWER GENERATION

[75] Inventor: Ben Z. Freedman, Hoshaia, Israel

[73] Assignee: Trustees of the University of Pennsylvania, Philadelphia, Pa.

[21] Appl. No.: 204,636

[22] Filed: Jun. 9, 1988

Related U.S. Application Data

[63] Continuation-in-part of Ser. No. 36,496, Apr. 9, 1987, abandoned.

[51] Int. Cl.[4] ..... F01K 25/06

[52] U.S. Cl. ..... 60/649; 60/673

[58] Field of Search ..... 60/649, 673

[56] References Cited

U.S. PATENT DOCUMENTS

| | | | |
|---|---|---|---|
| 3,516,249 | 6/1970 | Paxton | 60/655 X |
| 4,439,988 | 4/1984 | Minardi et al. | 60/649 |
| 4,460,545 | 7/1984 | Jouffroy et al. | 60/649 X |

*Primary Examiner*—Allen M. Ostrager

*Attorney, Agent, or Firm*—Woodcock Washburn Kurtz Mackiewicz & Norris

[57] ABSTRACT

Heat engines having improved efficiencies are provided. In accordance with preferred embodiments, topping cycle engines are provided employing ejectors. Use of ejectors in accordance with the invention permits higher high side temperatures while permitting work extraction devices to be operated at standard temperatures. A preferred sodium-helium system is described in detail.

17 Claims, 1 Drawing Sheet

USE OF EJECTORS FOR HIGH TEMPERATURE POWER GENERATION

CROSS REFERENCE TO RELATED APPLICATION

This application is a continuation-in-part of our prior copending application Ser. No. 036,496, filed Apr. 9, 1987, now abandoned which application is hereby incorporated by reference.

FIELD OF THE INVENTION

This present invention is directed to heat engines having improved efficiencies. More particularly, this invention provides heat engines which are operable at relatively high temperatures to secure such efficiencies. Ejectors are employed to permit such operation without undue negative impact upon structural components of the engines. Such improvements may be employed in a wide variety of contexts and with a wide variety of equipment including stationary and movable power generators, turbine systems, jet engines and the like.

BACKGROUND OF THE INVENTION

From basic thermodynamic theory it is known that the efficiency of heat engines becomes higher when the temperature of the heat source increases. A constant effort toward higher temperatures in power generation has been made throughout the history of heat engines. Today, most of the power generated in the world is secured in a steam Rankine cycle where the maximum steam temperature generally does not exceed about 560° C. When compared to gas turbines in which the temperature can reach about 1200° C. this seems to be quite low. This limitation is necessary because where where low cost and long life of the plant are primary factors, temperature and mechanical stresses must be kept at relatively low levels. The critical components in such systems are the turbine blades and the superheater piping which both must operate at relatively high temperature and under high stress.

Another problem that limits the use of higher temperatures in heat engines is ash deposition. This is most critical in coal burning plants, the most common present power source. The temperature in the superheater of such plants, which determines the maximum steam temperature, must be low enough that the ash entrained by the burned gas will stay solid and not stick to the tubes, blocking the gas passages. At higher temperatures, generally above about 870° C., the molten ash has a low enough viscosity that it flows down and does not accumulate on the tubes. This phenomenon is used in slag tap type furnaces and cyclone furnaces to remove a part of the ash from the flue gases. Parts of the furnace walls, which are water cooled, are hot enough that the ash deposited on them flows down to the slag tank. These types of boilers discharge less ash to the plant environment and need smaller ash separation equipment. If the temperature of the superheater convection bank were high enough, the flue gases would likely be even cleaner. No or very little particle emission control equipment would likely be needed.

Paradoxically, the combustion temperature in a typical furnace is very high, in some cases over 1700° C. A large and costly radiant space is generally needed to actually cool the burned gases. In the cyclone furnace, where the combustion process is completed in the small space of the cyclone chamber before entering into the main large furnace, cooling the gas is the only role of the bulky and expensive radiant space.

It is highly desirable to operate at higher steam temperatures which not only will improve efficiency, but will also eliminate the need for large, expensive furnaces while helping solve the problem of controlling flue gas ash. Construction materials are available which are sufficiently durable for extended periods of time at the higher temperatures required if operated under low stress. Unfortunately, the high steam pressures in modern plants, which can reach 3500 psia with concomitant equipment stress, limit the chances that the boiler temperatures can be raised considerably using existing technology.

Combined cycles can be used in known methods for constructing high temperature boilers at relatively low pressures. See, in this regard, *Thermodynamics,* by Reynolds, incorporated herein by reference. In these heat engines, which have been operated successfully in laboratories, a fluid, mercury in many cases, is evaporated at very high temperatures. The vapor expands in a turbine and then condenses while transferring its heat to water in the lower Rankine cycle. The heat exchanger between the two cycles requires only a relatively small area because the heat is transferred largely by the mechanism of evaporation and condensation. While these systems use a high temperature, low pressure boiler which can be built at reasonable cost even for large power plants, they still demand very high temperature turbines which are not now available for large scale use.

SUMMARY OF THE INVENTION

The novel heat engines of this invention employ a topping cycle, preferably in conjunction with another heat engine such as a Rankine cycle engine. Instead of expanding very hot, high pressure gases in a turbine which, as discussed above, is beyond the available technology, the gases are used to compress another fluid, preferably a gas, in an ejector. Due to the inherently simple construction and absence of moving parts in ejectors, the mechanical stresses in the ejector are minimal; it can operate efficiently at the desired high temperature. Only the conventional, lower temperature components of the system are required to operate at high mechanical stresses.

While it is known that ejectors have some inherent inefficiencies, turbines, which are more efficient, cannot tolerate the desired elevated temperatures. It has now been found that the foregoing system of ejector plus turbine yields overall efficiencies with concomitant cost savings. In some cases the ejector system can be substantially more energy efficient than the conventional topping, Rankine cycle. That will occur where the very high temperature vapor in a conventional topping cycle may have inferior thermophysical properties. As a result, the work which can be done in a turbine operating between the given pressure difference of the boiler and condenser may be low. If the same pressure difference is used to compress another gas with better thermophysical properties to operate the turbine, however, the turbine can work at smaller pressure difference but can do more work. The invention is applicable to both conventional closed systems and to open systems, such as reaction engines, alike.

OBJECTS OF THE INVENTION

It is a principal object of this invention to provide heat engines having improved efficiencies.

A further object is to provide such heat engines employing ejectors.

Yet another object is to secure the efficiencies of high net operating temperatures in heat engines without subjecting mechanical operating systems to temperatures where their physical integrity is compromised.

Other objects will become apparent from a review of the present specification.

DETAILED DESCRIPTION OF THE INVENTION

Figure 1:
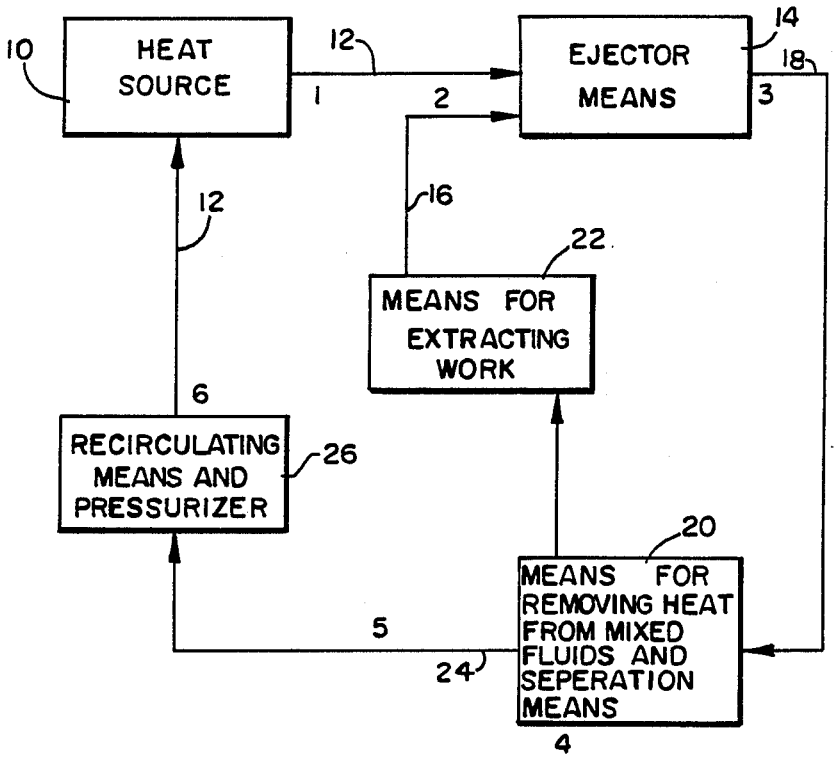
FIG. 1 is a flow chart of a closed system heat engine in accordance with one embodiment of the invention. Numerals 1 through 7 signify points in the cycle of an exemplary, calculated heat engine where operating parameters are determined.

Heat engines are provided comprising a heat source, primary fluid in thermal contact with the heat source and an ejector means for mixing the hot, high pressure primary fluid with a secondary fluid at low pressure. The mixed fluids, now a hot, mixed gas at medium pressure, contact means for removing heat energy from them. In this process, or subsequent to it, the primary and secondary fluids are separated, such as through phase change. The secondary fluid is then subjected to means for extracting work therefrom.

In accordance with preferred embodiments, the primary fluid is a vaporizable fluid, preferably an alkaline metal such as sodium, and the secondary fluid is an inert gas such as helium. It is also preferred to condense the primary fluid prior to its contacting the heat source to decrease the work needed for compression.

The means for removing heat energy from the mixed fluids is preferably a further heat engine such as a Rankine cycle engine. The separation step is preferably accomplished by causing the primary fluid to assume a liquid state while the secondary fluid remains a gas. The means for extracting work from the secondary fluid after its separation from the primary fluid is preferably a turbine, especially a gas turbine.

As stated, the invention preferably secures improved efficiency by operating at a higher high end temperature. Thus, the primary fluid preferably attains a temperature of at least about 1200° K., and more preferably, at least about 1500° K.

In another embodiment, the heat engines of this invention are "open", that is, they vent the working fluid to the environment. Such engines are useful, for example, in jet and other reaction engines. In accordance with these embodiments of the invention, work is extracted from the mixed fluids, preferably in the gaseous state, after the ejection step and the resulting downstream gases are vented after transferring heat to a lower cycle heat engine. While somewhat more costly when the fluids are expensive, these embodiments are also useful when low cost fluids are used, e.g. water or air. The work extracted from the mixed gases is preferably obtained by turbine means.

Improved heat engines now developed in accordance with the invention have thermodynamic power cycles which take energy from a very high temperature heat source. The temperature of the low temperature heat sink is high enough to operate conventional heat engines. Preferably, liquid is evaporated at a very high temperature, but at a pressure low enough that reliable boilers can be constructed. The hot, high pressure gas compresses another fluid, preferably a gas, in an ejector. Due to the inherently simple construction and the absence of moving parts in such ejectors, they operate well at high temperatures. The mixed fluids, now gases, which exit the ejector preferably exchange heat with a lower temperature heat engine in a process that preferably condenses the primary fluid. The secondary fluid preferably remains as a gas which drives a turbine (or other engine) which operates in a lower, conventional temperature range. The condensate is then preferably recycled in closed system embodiments or discarded in open systems.

Technological and economic considerations effect the selection of fluids, temperatures and pressures for the systems of the invention. Such systems using sodium and helium have been studied in computer assisted models; their main features are discussed and an illustrative example is analyzed below. When this heat engine uses a Rankine steam cycle as the lower temperature cycle as means for removing heat energy, the overall thermal efficiency of the system can be 5% to 30% better than the thermal efficiency of conventional steam Rankine cycles. At least about 5% improvement can be reached if the system is constructed from materials that are available today. When more advanced, high temperature materials become available, larger improvements will become possible. The fluids chosen for the examples of this specification were sodium for the primary fluid and helium for the secondary fluid. No extensive study has yet been done to find the best fluid combination. It is believed that helium is a good choice as a turbine fluid because of its low molecular weight and its high specific heat ratio, although it is harder to compress in the ejector. Sodium was chosen because there is existing experience in using sodium in energy systems and its thermophysical properties appear to be promising. Persons of ordinary skill in the art will recognize that the fluid systems have not yet been optimized in accordance with this invention and that improvements over the data calculated herein are to be expected without deviating from the spirit of the invention.

The ejector uses the energy in the heated primary fluid, e.g. sodium, to compress the secondary fluid, e.g. helium, from the pressure at the turbine outlet back to the pressure of the turbine inlet. The ejector also supplies the pressure needed to overcome friction in, for example, a steam generator. The compression is done by direct momentum exchange between the helium and the sodium through mixing and shear forces. Ejectors are known per se. See "Jet Pumps and Ejectors", Bonnington, S. T., Hemmings, J. A. G., *BHRA Fluid Engineering,* 1976 (Carnfield, Bedford MK430AJ, England) and "On the Rational Design of Compressible Flow Ejectors", Ortwerth, P. J., AIAA Paper 79 1217 which are incorporated herein by reference. More information concerning basic theory, empirical data and applications can be found incorporated herein by reference.

In accordance with the invention, the primary fluid may be any which is vaporizable at the high end operating temperature of the engines. Alkalai metals are preferred and sodium most preferred. Secondary fluids may be any which can be separated from the primary fluid used, are stable therewith and which have acceptable operating parameters within the spirit of the invention. Inert gases are preferred with helium most preferred on cost grounds.

The mixing takes place in a preferably convergent mixing section of the ejector where the secondary fluid enters at subsonic velocity and the primary fluid preferably at supersonic velocity. The mixing is done at a pressure that is generally lower even than the pressure at the turbine outlet. This pressure is preferably kept constant throughout the mixing. There is an optimal mixing pressure for each system which can be attained using known ejector theory and routine experimentation. The pressure of the primary fluid, e.g. sodium vapor, is reduced to the mixing pressure, which may be 30 times lower, by expanding the fluid such as in a supersonic nozzle. After the mixing, the gases are also generally supersonic; they are preferably compressed and slowed, first by shock waves in a supersonic diffuser and then by expansion in a subsonic diffuser.

There are inherent entropy losses in the mixing and shock wave processes. Those losses are the reason why compression in an ejector needs more energy than compression in an equivalent mechanical compressor. However, since the ejector uses heat instead of mechanical energy the ejector can effect overall efficiencies.

Condensation may occur in the supersonic nozzle where the temperature may be lower than the boiling temperature of the primary fluid, e.g. sodium, at the pressure extant there. This condensation will not be completed because the high velocities of the gases will tend to delay the condensation and to leave the vapor in a subcooled state. If the amount of sodium condensing is too large, the heat released in the process may choke the flow and the ejector will not be able to compress the secondary fluid. If, on the other hand, only a small fraction of the primary fluid condenses, the ejector performance may even be improved a little. Persons of ordinary skill in the art will recognize this phenomenon and compensate for it.

Condensation may also occur near the ejector outlet. The temperature of the mixed fluids may be higher or lower than the dew point temperature of the fluid mixture. The mixed fluid (gas) temperature depends on the temperature of the gases entering the ejector; the dew point temperature depends on the pressure and on the mass ratio between the gases. No condensation will occur if the mixture temperature is above the dew point temperature, when it is lower, part of the primary fluid may condense. The condensation will increase the gases' temperature and decrease the concentration until equilibrium is reached. Heat added to gas flow tends to reduce its stagnation pressure. This effect is stronger as the initial velocity of the gas becomes higher. It is more desirable, therefore, that condensation, if it occur at all, take place as near to the ejector outlet as possible. This may be the situation in practical cases because the lower pressure inside the ejector, far from the outlet, reduces the dew point temperature there and because the high velocity there tend to keep the vapor subcooled.

There may be instances where the mixture temperature is lower than needed by the steam generator. In these cases, it may be necessary for condensation to take place before the mixture enters the heat engine, heat exchanger (or steam generator), so that the temperature there will be increased. In other cases, where the mixture temperature before condensation is high enough, it may be desirable that the flow enter the heat engine, heat exchanger or steam generator before equilibrium is reached so that the condensation will take place on the heat exchanger tubes. In that case there will be no pressure loss due to flow heating and the heat transfer in the heat exchanger will be more efficient.

The configuration of the ejector may take many forms: cylindrical, ring shaped, toroidial and others. Each ejector contains four basic elements: a mixing section, supersonic nozzle(s), a supersonic diffuser and a subsonic diffuser. The flow in the ejector can be radial or axial. Ejectors having cylindrical flow comprise a type that is well known and has a large theoretical and empirical data base. Cylindrical cyclone-type ejectors have been described in the literature but their theoretical treatment is much more complicated; their empirical data are scarce.

For large systems, the toroidial cyclone ejector will likely be the most suitable because systems built in this shape have the smallest volume and surface area. The flow in this type of ejector is more complicated even than the cylindrical cyclone type but modern three-dimensional analysis can provide suitable analyses for this type.

By reference to FIG. 1, a preferred heat engine in accordance with a preferred embodiment is provided having a primary fluid, 12 in thermal contact with heat source 10. Ejector means 14 are provided for mixing secondary fluid, 16 with the hot, compressed primary fluid 12. Means for removing heat energy from the mixed fluids, 20 is also extant. This feature may preferably comprise a further heat engine such as a Rankine cycle engine or heat exchange apparatus. This means preferably also effects separation of the primary and secondary fluids. The primary fluid is preferably recycled in closed systems by recirculating means 26 which preferably also serves to pressurize the primary fluid for further contact with the heat source. The separated secondary fluid, preferably still in the gaseous state, is subjected to means for extracting work therefrom, 22. The secondary fluid 16 is then recirculated to the ejector 14 in closed systems. Numerals 1–7 denote locations in the engine cycle referred to in Table 1 hereto.

Exact computation of even the simplest kind of ejector requires sophisticated analytical techniques. When condensation processes of subcooled vapor are considered, experimental correlation becomes necessary as well. In the analysis done below, a simple, one-dimensional, inviscid approximation of an ideal gas flow is made. The analysis was performed using sodium as primary fluid and helium as secondary fluid. The computation was done with a computer program set forth in appendix A hereto. This program is a conventional treatment of supersonic constant pressure ejectors using the laws of conservation of mass, momentum and energy, together with one-dimensional gas dynamic connections between the flow parameters and relations before and after normal shock wave. Table 3 summarizes the computation done by the program for the example. This computation takes into account an empirical value of 25% stagnation pressure loss due to friction inside the ejector that is not accounted for by the theory.

Abbreviations employed are:

A—Area $C_p$—specific heat capacity at constant pressure

D—diameter h—specific enthalpy

H—enthalpy k—ratio of specific heat m—mass flow rate

M—Mach number
P—pressure
Q—heat
T—temperature
V—volume
W—molecular weight
a subscript—air entering the combustion
g subscript—gas
l subscript—liquid The analysis was performed for sodium as primary fluid and helium as secondary fluid. Condensation effects in the supersonic nozzle are assumed to reduce the mass of helium that can be compressed by about 10% from the mass computed and to increase the mixed gas temperature by about 90° C. (10% of the temperature in Kelvin degrees).

To calculate the equilibrium state of the mixture at the ejector outlet the vapor pressure of the sodium must be known. This is given by following the equation:

$$\ln P = 18.832 - 13113/T - 1.0948 * \ln T + 1.99777 * 10^{-4}$$

where:

P is the vapor pressure of the sodium in ata, and
T is the temperature in degrees Kelvin.

The total pressure, $P_{tot}$ is the sum of the partial pressures. According to Dalton's law, it is related to the molar mass ratio by:

$$X = \frac{m_{Na}}{m_{He}} = \frac{P_{Na}}{P_{tot} - P_{Na}} \times \frac{W_{Na}}{W_{He}}$$

X—is the concentration of the sodium, and
W—is the molecular weight

In cases where the mixture temperature is below the dew point temperature, the heat of vaporization of sodium and the average specific heat capacity of the mixture is needed in order to find the equilibrium state. The calculation is performed by estimating an equilibrium temperature and calculating the sodium concentration at this temperature and the amount of sodium that is needed to be condensed to reach this concentration. Whether the heat added by condensation increases the mixture temperature to the estimated temperature is ascertained. The initial estimate is corrected if needed and a regression performed. In the example described in Table 1 relating to the exemplary sodium, helium system described herein and in FIG. 1, the dew point temperature is 910° C., and is equal to the mixture temperature which is, therefore, the equilibrium temperature.

TABLE 1

Fluid parameters at the various locations in FIG. 1

| Ref. No | Fluid | T °K | P ATA | W | k | m Kg/sec | M | A cm² |
|---|---|---|---|---|---|---|---|---|
| 1 | Na, gas | 1500 | 10.8 | 23 | 1.5 | 1 | 0.2 | 28. |
| 2 | He + 5% Na,g | 450 | 0.4 | 4 | 1.65 | .34 | 0.8 | 116. |
| 3 | He + Na,g | 910 | 1.0 | 12 | 1.58 | 1.34 | 0.4 | 231. |
| 4 | Na,g + Na,l + He | 910 | 1.0 | 12 | 1.58 | 1.34 | 0.4 | 231. |
| 5 | Na,l | 600 | 0.9 | 23 | — | 1 | — | — |
| 6 | Na,l | 600 | 10.8 | 23 | — | 1 | — | — |
| 7 | He | 600 | 0.9 | 4 | 1.65 | .34 | 0.4 | 90. |

Heat loss from the exterior surfaces may reduce the system efficiency to a degree that the proposed system will not be significantly better than a conventional one. There are some means for reducing the system size but each one has its own limitation. Following is a brief discussion of some of them.

Raising the outlet pressure of the ejector will reduce the gas volume but will still require large and strong structures. Moreover, using higher ejector pressure prevents the use of relatively low pressure and temperature sodium boiler.

The compression ratio of the ejector also affects the system size. At higher compression ratios, smaller helium mass flow rates are needed to do the same work. Because the helium is the main cause for the big volume, using less helium will reduce the size. For better system efficiency, however, it is preferable to operate near the optimal compression ratio, which is quite low. A compromise should be made, therefor, between system size and efficiency.

A possible way to achieve high compression ratio without decreasing the efficiency excessively is through the use of multi-stage ejectors. Each stage is operated at the optimal compression ratio; after each stage the sodium or other primary fluid is condensed in, for example, a steam generator and the helium is again compressed in the next stages. This kind of system requires only small turbines and configurations where increases in total length affect the overall size less than the decrease in cross section area; smaller system sizes can be achieved.

Ejector size can be reduced by operating then at higher gas velocities. The velocity of the helium entering the mixing area has to be matched to other parameters in order to achieve the highest ejector efficiency. Fortunately, in most cases, these velocities are close to the velocity of sound. The turbine should be designed, therefore, so that the velocities of the gas emerging from it and entering the ejector will be high and the volume needed to adjust velocities will be small. High velocities at the ejector outlet are more problematic. Stagnation pressure losses due to friction and heat added to the flow by condensation are higher when the gas velocities are higher. In most cases these losses outweigh the benefit of higher velocities: greater heat transfer coefficient and the increase of stagnation pressure due to cooling in the steam generator. Here, also, a compromise between size and efficiency should be made. The Mach number of 0.4 chosen for the example although not based on extensive study, seems to be reasonable.

Using other fluids in combination rather than the helium-sodium selected here may also effect the system size and may result in smaller and more efficient systems. Such systems are contemplated by the present invention.

Estimates for the size needed for helium-sodium systems, operating at different pressures, are set forth in Table 2. Note that in the table, the ejector throat diameter is the diameter in a conventional cylindrical configurations. Overall diameters of a toroidial system are 2 to 4 times this diameter.

TABLE 2

Features of different 50 Mw sodium-helium system

| | | | | | |
|---|---|---|---|---|---|
| Boiler Pressure ATA | 2.0 | 10.8 | 10.8 | 50 | 50 |
| Boiler Temperature °K | 1250 | 1500 | 1500 | 2000 | 2000 |

TABLE 2-continued

| Features of different 50 Mw sodium-helium system | | | | | |
|---|---|---|---|---|---|
| Ejector Outlet Pressure ATA | 0.2 | 0.2 | 1.0 | 1.0 | 5.0 |
| Efficiency improvement over 40% steam plant | 11% | 18% | 11% | 20% | 13% |
| Diameter of Ejector Throat cm | 128 | 160 | 57 | 74 | 29 |

Heat energy is removed from the mixed fluids after the ejection step. This removal is preferably through a further heat engine, such as a steam generator. The steam generator produces steam needed for Rankine cycle, for example, through heat exchange with the mixed fluids, elgl, sodium and helium, emerging from the ejector. This process preferably condenses the sodium and cools the helium and the condensed sodium. The pressures and temperatures of the steam are those found in boilers, superheaters, reheaters and economizers of conventional power plant. The heat transfer rates in the steam generator are much higher than in fire heated boilers and are higher even than those found in liquid sodium steam generators. The heat transfer area needed is therefore much smaller than needed for conventional boilers. The main difference is in the coefficient of heat transfer on the gas side. A large fraction of the heat is transferred by condensation of the sodium, in the example it is 75%. Condensation heat transfer rate of pure sodium is two orders of magnitude larger than the heat transfer rate of burned gasses. Because of the high heat of evaporation and the high thermal conductivity of sodium, it is about 30 times higher than the heat transfer rate in the condensation of steam. When sodium vapors are mixed with the helium, the heat transfer coefficient of the mixture is between that of helium and that of condensing sodium. The value can be estimated as a linear function of the sodium mass concentration. As a result, in parts of the steam generator where the sodium concentration is not too low, the gas side resistance to heat transfer can be neglected. In the steam generator section, where water is evaporated, the heat transfer rate is determined mainly by the conductivity of the tubes. In part of the steam generator where the sodium concentration is low, the heat transfer coefficient is that of the helium which is still 10 to 20 times higher than that of burned gases in furnaces.

The low density of the helium makes it possible to reach higher velocities than can be reached by air in similar situations. Part of the heat is transferred by the liquid sodium which also has very high heat transfer coefficient. The tubes in the steam generator are free from ash deposition that lower the heat transfer in fire heated system. Moreover, the heat content of a unit mass of helium-sodium mixture is about 3 to 5 times higher than the heat content in a unit mass of burned gas. The mass flow rate of the water should be higher too. Especially high mass flow rate is needed in the superheater. On the water side the heat transfer rate is much lower than on the gas side, where subcooled sodium vapor condenses very fast on the tube walls. If the steam cannot absorb enough heat, the tube temperature may increase dangerously.

The actual area needed for the heat transfer in the steam generator may be higher than calculated from the heat transfer rates. The cross-sectioned area needed for the flow of the helium sodium mixture is large; the heat transfer area should be large enough to assure that all the gases will be in contact with the steam tubes to enable exchange of heat. Nevertheless, the total area of the steam generator is still relatively small and does not have a great effect on the system total volume. This volume is determined by the area needed for the gases flow as discussed earlier.

The temperature of the gas leaving the steam generator has effects that should be considered. Higher temperature means that the temperature of the gas entering the turbine will be higher and more work per unit mass can be extracted from the turbine. On the other hand, the concentration of sodium vapor in this gas will be higher and sodium that may condense within the turbine may disturb its operation. Another disadvantage of the higher temperature of helium leaving the steam generator is that the water entering it will have to be at higher temperature, achieved by direct heating by the burned gases. The lower cycle than uses more heat than the topping cycle and the overall system improvement, achieved by the topping cycle, is therefore somewhat lower.

The combination of sodium and water in a heat exchanger requires special safety measures. Leaks of steam into the sodium will result in strong chemical reactions; the heat released would cause great damage. There is some experience in heat exchangers which use liquid sodium and water in experimental nuclear power plants cooled by sodium.

The primary liquid, e.g. sodium, is evaporated in a furnace operated at higher temperature than used for conventional steam boilers. In order to achieve high temperature, the combustion is preferably done in a cyclone furnace, which has a small chamber in which a high speed rotating air stream is used to burn the fuel in an almost adiabatic process. The air needed for the combustion is heated in a high temperature air heater by exchanging heat with the burned gases leaving the furnace. The combustion temperature is determined by the temperature of the entering air, the quality of the fuel, the amount of excess air and the amount of heat transferred to the walls. This temperature may conveniently be 2300° C., be found in conventional cyclone urna and can reach 3500° C. and higher if special high temperature air heaters are used.

The furnace walls are covered, on the fire side, by an insulating layer of molten ash. Its temperature is kept at the desired level by boiling sodium. The hot gases which leave the cyclone chamber heat the main convection bank in which the sodium is evaporated.

The temperature of the convention bank tubes is high enough that the viscosity of the molten ash is low allowing it to drop down to the slag tank and not be accumulated on the tubes. As a result, the gases leaving the furnace contain only low amounts of ash compared with conventional furnaces; the problem of cleaning deposited ash from the tubes is eliminated.

The sodium is heated mainly by convection. There is no need for a radiant space where heat is exchanged by radiation only and is subsequently cooled in order to prevent excessively hot gases from reaching the convention tube bank, as needed in conventional systems. The rate of heat transfer on the gas side is, therefore, relatively high.

The boiling and heating heat transfer rates, on the sodium side, are much higher than the rates for water and steam because of the higher conductivity and heat of evaporation of sodium. Moreover, the fraction of heat transferred in the boiling process, in the sodium furnace, is about 75% of the total heat exchanged compared to about 50% and less in high temperature steam boilers. As a result, the overall heat exchange area needed in the sodium furnace is ten to twenty times less than is needed to generate steam with the same heat content.

The heat content of a unit mass of sodium vapor is about two times greater than the heat content of high temperature steam. Thus the mass ratio between the burned gases and the sodium will be higher than the ratio between burned gases and steam in conventional systems. The sodium mass flow rate will, therefore, be considerably lower.

The lower pressure and density of the sodium vapor makes the volume needed to contain it quite large. The sodium boiler is characterized by having a small heat exchange area, a low sodium mass flow rate, low pressure, a high temperature, and a high vapor volume.

Superalloys have fairly good resistance to corrosion caused by sodium and burned gases, however the maximum temperature that can be attained is limited. At high temperatures the phenomena of creep is very important; it affects the allowable temperature and stress. The long term yield strength can be a tenth of its short term value. There are a number of alloys that can be used satisfactorily for many years at temperatures of 1100° K. (1600° F.) while under tensile stress of 1000 psi. As the temperature is increased, however, the allowable stress falls off sharply. At a temperature of 1250° K. (1800° F.), only a few alloys can withstand usual stresses longer than a few years.

One strategy that could be used to allow higher temperature is to build a fire tube boiler. In a fire tube boiler, the tubes that serve as the heat transfer media and are thus exposed to the high temperature, under compressive loads only. Compressive yield strength is generally higher than tensile yield strength and the effect of creep is less significant. The parts of the boiler that are under tensile loads are maintained at lower temperature by using thermal insulation. This approach is possible because the pressure in the boiler is relatively low. It is not suitable for use with the high pressures found in steam boilers. It is estimated that the maximum allowable temperature in this fire tube boiler could reach 1500° K. with a maximum pressure, therefore, of about 11 ATA.

Higher temperature may be achieved with nonmetals: graphite and ceramic, or with composite materials. Graphite has excellent stability at high temperature and it does not creep. Its yield strength increases with the temperature and is approximately 5000 psi at 2000° K. This is high enough to be used for pressure tubes up to 100 ATA with reasonable wall thicknesses. Unfortunately, graphite is chemically attacked by the hot sodium and oxygen. The only way it could be used is by insulating it and preventing contact with the gases surrounding it. Coating is a successful way to prevent oxidation of graphite at high temperatures and continuous effort is being made to find better graphite coating for uses such as reentry bodies and rocket throats. One might also try to insert graphite tubes between two metal tubes which are plastic at high temperatures but can be efficient insulation. Ceramic materials are continuously improved for use in high temperature energy systems and impressive advances have been made in recent years. It seems reasonable that ceramic materials for the high temperature, low pressure boilers will be developed and will thus be useful. There is a good chance that with new construction materials temperatures of 2000° K. and above can be reached.

The turbine may be axial or radial or any combination of these types. Because it is operated at relatively low compression ratios few stages will be needed along the flow direction and in that direction it should not be too large. However, because of the large cross section area required its diameter will be comparatively large. This imposes technological and aerodynamical restrictions.

To further illustrate the invention, a special case of helium-sodium system is analyzed. While actual experimentation has not been performed, computer simulation has been completed. Actual data will require major expenditures of time and financial resources. The main parameters of this example are:

boiler temperature 1500° K.
boiler pressure 11 ATA
ejector outlet pressure 1.0 ATA
ejector compression ratio 0.4
temperature at the steam generator outlet 600° K.
electric power generation 50 Mw Choosing other parameters may result in different systems which may be more suitable for practical cases. No effort was made to find the most efficient or most economic system; parameters were chosen so that the analysis would not be too complicated. However, the example describes a system that can be built in practice; the parameters have values which, although sometimes arbitrary, are used in analysis of conventional systems.

The first step in the analysis is to choose the compression ratio of the ejector. The compression ratio of the turbine is that of the ejector less the pressure gradient lost in the steam generator and droplet separator. A compression ratio about 0.6 gives the maximum turbine work. But if the value of 0.4 is chosen instead, the work done is reduced only by 10% but the helium mass flow rate is reduced by almost 50% and the system size will therefore be much smaller. That lower value has thus been chosen in the example.

Table 3 lists the ejector parameters which are computed by the computer program listed in appendix A hereto. Input parameters are signed by an asterisk. The sodium mass flow rate was chosen as 1 Kg/sec for simplicity. Other input parameters specify the fluid properties, the temperatures and the pressures of the example.

TABLE 3

Ejector parameters as computed by the computer program

| | Parameters | | | | | | | | |
|---|---|---|---|---|---|---|---|---|---|
| Locations | m Kg/se | $P_O$ ATA | P ATA | TO °K. | T °K. | M | W | k | A $cm^2$ |
| Before Na Mixing | 1.0 * | 10.8 * | .30 | 1500 * | 441 | 3.02 | 23. * | 1.5 * | 35.7 |
| Start He | .380 * | 0.4 | .30 * | 450 | 431 | 0.6 * | 4. * | 1.65 | 147. |
| At ejector | 1.38 | 1.0 | — | 820 | — | — | 10.0 | 1.6 | — |

TABLE 3-continued

| Locations | Ejector parameters as computed by the computer program | | | | | | | | |
|---|---|---|---|---|---|---|---|---|---|
| | Parameters | | | | | | | | |
| | m Kg/se | $P_O$ ATA | P ATA | TO °K. | T °K. | M | W | k | A $cm^2$ |
| outlet | | * | | | | | | | |
| At sodium nozzle | .380 | 10.8 | — | 1500 | — | 1.0 | 23. | 1.5 | 9.6 |
| throat | | | | | | | | | |
| At ejector throat | 1.38 | 1.51 | .30 | 820 | — | 1.67 | 10. | 1.6 | 132 |

The computation results include 25% pressure loss due to friction effects inside the ejector which are not accounted for by the one dimensional model used. This value is an estimate based upon empirical values conventionally used in ejectors. Possible condensation effects in the primary nozzle cannot be determined without experimental data; they have been estimated. The helium mass flow rate was decreased by 10% (from 380 to 340 gr/sec); the ejector outlet temperature increased by 10%. The corrected values are listed in Table 1.

The work done by the turbine, W, can be computed by assuming expansion of an ideal gas isotropically, taking into account turbine efficiency which will be 0.9 in this example. The calculation goes as follows:

$$\begin{aligned} W &= 0.9*m_{He}*(h_7 - h_2) \\ &= 0.9*m_{He}*C_p*(T_7 - T_2) \\ &= 0.9*m_{He}*C_p*T_7*(1 - T_2/T_7) \\ &= 0.9*m_{He}*C_p*T_7*[1 - (P_2/P_7)^{(k-1)/k}] \end{aligned}$$

where:

| | |
|---|---|
| $m_{He}$ | = mass flow rate of the helium |
| $h$ | = specific enthalpy |
| $C_p$ | = specific heat capacity |
| $T$ | = temperature |
| $P$ | = pressure |
| Subscript 7 | = before the turbine |
| Subscript 2 | = after the turbine |

Pressure losses due to friction in the steam generator and droplet separator are assumed to be 10% of the compression rate generated by the ejector and the turbine expansion ratio will be, therefore, 0.44 (compared to 0.4 at the ejector).

The actual work done by the turbine is:

$$W=0.9*0.34*5.2*600*[1-0.44^{(1.67-1.)/1.67}]=268\ KJ/sec$$

5.2 KJ/Kg-C° was used as the helium specific heat capacity and 1.67 as its specific heat ratio.

The heat absorbed by the sodium from the burned gases can be calculated. It is the enthalpy difference between the liquid sodium at a temperature of 600° K. and the sodium vapor at 1500° K., multiplied by the sodium mass flow rate:

$$Q=(5220-520)*1.0=4700\ KJ/Kg\text{-}sec$$

The energy supplied by the fuel must be higher due to combustion inefficiencies that include heat lost in the hot gases leaving the stack, heat loss from the furnace exterior surface, incomplete combustion and latent heat of the flue gases.

The total combustion efficiency coefficient of 0.82 is used, taking into account all of the above-mentioned factors. In conventional, big furnaces even higher values are common. The heat that is supplied by the fuel $Q_f$ will be therefore:

$$Q_f=4700/0.82=5700\ KJ/Kg\text{-}sec$$

A power plant of 50 Mw which operates at overall thermal efficiency of 45% uses fuel energy of 50/0.45=111 Mw. The mass flow rate of sodium needed for this plant is:

$$111{,}000/5700=20\ Kg/sec.$$

Assuming that high quality coal is used with heat content of 32,000 KJ/Kg the mass of the coal needed is 5700/32,000=0.18 Kg/sec. Assuming that the excess air needed for the combustion is 15%, the mass of air needed is 18 times the mass of the coal. This value is used in conventional systems and is used in the example although lower values may be enough for the very high combustion temperature of the example. The mass of the burned gases is $0.18\times18=3.24$ *Kg/sec* while the air mass flow rate is $3.24-0.18=3.06$ *Kg/sec.*

The temperature of the burned gases leaving the sodium boiler is assumed to be 50° K. higher than the temperature at the boiler. In the example, it will be, therefore, 1550° K. That temperature difference is needed to assure complete evaporation of the sodium before the burned gases are cooled too much. It is necessary to distinguish between the sodium boiler, where the sodium is evaporated, and the sodium heater, where liquid sodium is heated. Temperature differences lower than about 50° K. will result in more efficient systems but the boiler heat exchange area would have to be larger.

The specific heat capacity of the burned gases at the relevant temperatures is 1.46 KJ/Kg-°K. (0.35 BTU/lbm-° F.). The heat of evaporation of sodium at 1500° K. is 3560 KJ/Kg. Using the mass flow rate of the burned gases, the temperature $T_{g1}$ of the burned gases entering the sodium boiler can be calculated as $T_{g1}=1550+3560/(1.46*3.24)=2300°$ *K. The heat needed to raise the temperature of the liquid sodium from* 600° K. to 1500° K. is 1140 KJ/Kg, and the gas' temperature at the exit from the sodium heater $T_{g3}$ will be $T_{g3}=1550-1140/1.34/3.24=1290°$ K. Here the specific heat of the burned gases was adjusted to the lower temperature at the sodium heater.

The temperature of the gases leaving for the stack is assumed to be not lower than 420° K. This temperature depends on the type of fuel used and cannot be lowered to avoid sulfuric acid formation. The amount of heat in the burned gases, $Q_{g34}$, available for heating the air entering the furnace, is calculated using the relevant specific heat capacity of 1.2 KJ/Kg−°K. as $Q_{g34}=(1290-420)*3.24*1.2=3380$ *KJ.* This value will be used in the analysis of the air heater.

The sodium boiler efficiency is $3560/(2300-1500)/(1.46*3.24)=0.94$

The exact pressures and temperatures of the water and steam do not make much difference in this analysis. A super critical steam boiler which uses bleed feed water heating was used. The feed water enters the steam generator at 400° K. and the steam exits at a temperature of 810° K. The enthalpy difference between these temperatures at a pressure of 240 ATA (3400 psi) is about 2100 KJ/Kg and the amount of steam generated will be therefore 4700/2100=2.2 Kg. If a reheat cycle is used the amount of steam will be lower.

The enthalpy of the burned gases at 2300° K. with 5% moisture is 2560 KJ/Kg (1090 BTU/lbm). Their heat content is $Q_{g1}=2560*3.24=8300$ *KJ.*

Assuming 3% heat loss through the furnace walls and using the value of heat supplied by the fuel as was calculated before, 5730 KJ, the heat content, $Q_a$, and the enthalpy of the air entering the combustion, ha, needed to achieve the desired combustion temperature of 2300° K. can be calculated as:

$$Q_a = 8300 - 5730 + 5730*(3/100) = 2740\ KJ$$

and $$h_a = 2740/3.06 = 895\ KJ/kg$$

The heat capacity of air between 350° K. and 1150° K. is 1.1 KJ/Kg-°K. and the temperature of the air entering the furnace $T_{a2}$ is $T_{a2}=300+895/1.1=1110°$ *K.* assuming an ambient air temperature of 350° K. (80° F.).

Air heater efficiency is defined as the ratio of the heat exchanged in practice to the available heat. The heat exchanged is the heat added to the air which is 2470 KJ and the heat available, as was calculated already, is 3380 KJ. The heat exchanger efficiency is 2730/3380=0.8 which is quite low.

Heat loss through the exterior wall of the ejector must be considered because the large surface area results in substantial heat loss. This heat loss depends also on the temperature of the inner wall, insulation quality, ambient temperature and wind speeds. The average temperature on the ejector inner wall is 700° K. and the temperature difference on the wall is, therefore, 400° K., which is about half the temperature difference in conventional steam boilers. Values of heat loss per unit area of 0.16 Kw/m (100 BTU/ft -hr) are used, about one quarter of the loss in conventional boilers.

The system configuration is assumed to be the compact, toroidial one. A reasonable estimate is that the toroid overall diameter is about three times the ejector throat diameter and its height is equal to this diameter. The ejector throat area for 1 Kg/sec sodium is 130 $cm^2$ (as can be seen in Table 3) and for 20 Kg/sec it will be 2600 $cm^2$ with a diameter of 57 cm. The total exterior surface area can be estimated by calculating the surface area of an equivalent cylinder which is about 8.0 $m^2$. The heat lost through the ejector exterior surface (including the steam generator and the turbine) is $Q_{loss}=8*0.16=1.2$ *kw,* which can be neglected.

The lower steam cycle can be assumed to have an overall efficiency of 40% including the combustion inefficiencies discussed earlier. The work done by the steam turbine $W_{st}$ is therefore $W_{st}=111{,}000*0.4=44{,}400$ *KJ/sec.* The work done by the helium turbine $W_{He}$ is $W_{He}=268*20=5360$ *KJ/sec.* The work equivalent of the heat loosed through the ejector exterior surface is 1.2*0.4=0.480 *KJ/sec.* The extra work done by the topping cycle is 5360−0.480=5360 *KJ/sec.* The improvement achieved by the topping cycle over the conventional lower cycle is 5360/44400*(100)=12.0%. Thus, it can be seen that the present invention provides improved heat engines with increased efficiencies.

What is claimed is:

1. An improved heat engine comprising
- a heat source;
- primary fluid in thermal contact with the heat source;
- ejector means for mixing a secondary fluid with the primary fluid after the primary fluid has contacted the heat source;
- means for removing heat energy from the mixed fluid and for separating said primary and secondary fluids; and
- means for extracting work from the secondary fluid subsequent to its separation from the primary fluid.

2. The heat engine of claim 1 wherein the primary fluid is an alkali metal and the secondary fluid is an inert gas.

3. The heat engine of claim 1 wherein the primary fluid is sodium and the secondary fluid is helium.

4. The heat engine of claim 1 further comprising means for compressing the primary fluid prior to thermal contact with the heat source.

5. The heat engine of claim 1 wherein the means for removing heat energy from the mixed fluids comprises a further heat engine.

6. The heat engine of claim 5 wherein the further heat engine comprises a Rankine cycle engine.

7. The heat engine of claim 1 wherein the secondary fluid is a gas and the work extraction means comprises turbine means.

8. The heat engine of claim 1 wherein the primary fluid changes from a liquid to a gaseous state upon contacting the heat source.

9. The heat engine of claim 8 wherein the primary fluid is separated from the secondary fluid by returning to the liquid phase.

10. The heat engine of claim 1 wherein the primary fluid attains a temperature of at least about 1200° K. upon contacting the heat source.

11. A method for extracting work from a heat source comprising:
- contacting the source with a primary fluid;
- mixing with the primary fluid a secondary fluid in ejector means;
- removing heat from the mixed fluids in a heat engine means;
- separating the primary and secondary fluids; and
- extracting work from the secondary fluid.

12. The method of claim 11 wherein the primary fluid is an alkali metal and the secondary fluid is an inert gas.

13. The method of claim 11 wherein the primary fluid is sodium and the secondary fluid is helium.

14. The method of claim 11 further comprising compressing the primary fluid prior to thermal contact with the heat source.

15. The method of claim 11 wherein the heat engine means is a Rankine cycle engine.

16. The method of claim 11 wherein the secondary fluid is a gas and the work extraction comprises passing the separated gas through turbine means.

17. The method of claim 11 wherein the primary fluid attains a temperature of at least about 1200° K. upon contacting the heat source.

* * * * *